United States Patent [19]

Haas

[11] 4,358,115

[45] Nov. 9, 1982

[54] GEOMETRIC FIGURE BUILDING SET

[76] Inventor: Rudi Haas, 46 Elgin St., Suite 29, Ottawa, Ontario, Canada, K1P 5K6

[21] Appl. No.: 169,203

[22] Filed: Jul. 15, 1980

[51] Int. Cl.[3] ..... A63F 9/10

[52] U.S. Cl. ..... 273/157 R; 52/311; 434/211

[58] Field of Search ..... 273/157 R; 46/24, 26, 46/19, 25, 30; 434/195, 196, 211, 212, 403; 52/311; 404/34, 41, 42

[56] References Cited

U.S. PATENT DOCUMENTS

| | | | |
|---|---|---|---|
| 955,194 | 4/1910 | Peacock | 273/157 R |
| 1,261,710 | 4/1918 | Coyle | 273/157 R |
| 1,430,557 | 10/1922 | Jervis | 273/157 R |
| 2,738,594 | 3/1956 | Swingle | 273/157 R |
| 2,885,207 | 5/1959 | Wormser | 273/157 R |
| 2,886,324 | 5/1959 | Cowan | 273/157 R |
| 2,900,190 | 8/1959 | Pestieau | 273/157 R |

FOREIGN PATENT DOCUMENTS

| | | | |
|---|---|---|---|
| 216154 | 2/1922 | Canada | 273/157 R |
| 264897 | 10/1928 | Canada | 273/157 R |
| 2139303 | 2/1973 | Fed. Rep. of Germany | 273/157 R |
| 497253 | 9/1954 | Italy | 46/19 |
| 110116 | 10/1917 | United Kingdom | 46/24 |

OTHER PUBLICATIONS

Sifo Catalog (1979), p. A.
LaPine Catalog (1979), p. 5.

*Primary Examiner*—Anton O. Oechsle
*Attorney, Agent, or Firm*—Stevens, Davis, Miller & Mosher

[57] ABSTRACT

A set of generally flat, geometric figure building elements is disclosed, particularly (but not necessarily) for use in a geometric puzzle. The set combines an uneven number of pieces or elements, of which one type is square-shaped and the other types are right-angled isosceles triangles, one of which has the sides equal to the sides of the square pieces, while the other type is of the shape of right-angled triangles whose bases are of the same length as the sides of the square pieces. The puzzle produces advance in that it combines extreme simplicity of the pieces with the possibility of a wide variety of difficulty in assembling different shapes from the entire set. In a preferred embodiment, at least some of the pieces display a centrally located dot-like figure in one surface only thereof, to enable the creation of animal or man-like figures in which the dot presents representation of the eye, or to facilitate recognition of a particular piece in an overall shape to be solved.

2 Claims, 9 Drawing Figures

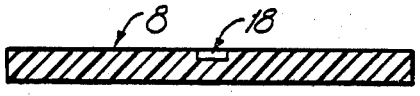
Fig-6
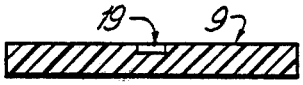
Fig-5
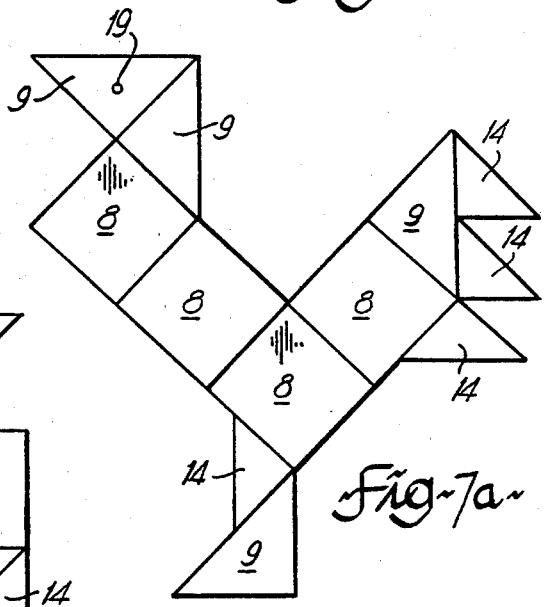
Fig-7a
Fig-7b
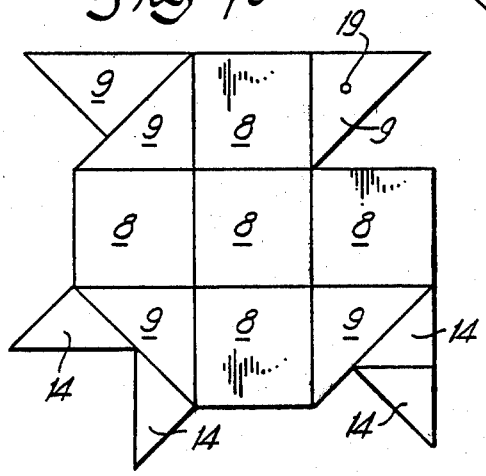
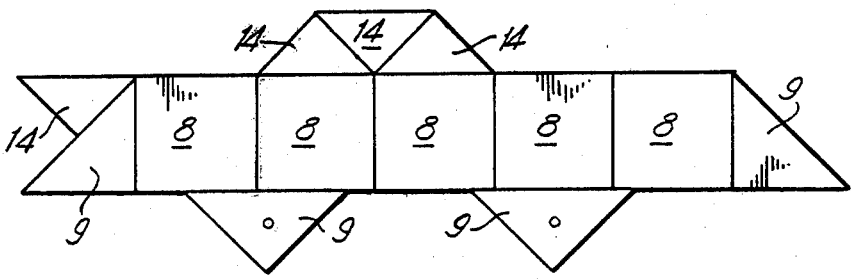
Fig-7c

GEOMETRIC FIGURE BUILDING SET

The present invention relates to a set of straight-sided, generally flat geometric figure building elements. In particular, the present invention relates to the art of geometrical puzzle games. However, the application of the invention is a broad spectrum of further fields such as, for instance, modular furniture, ornamental tile sets, building slab sets or the like is no less readily conceivable.

Puzzle games of the above type have been known for many years, even centuries. It has been recognized in the past that too much of ease in forming figures from a puzzle game low number of simple shaped pieces is undesirable as interest in the game quickly lagged. Adults only had passing interest in that kind of games.

Attempts have been made to solve the above problem by multiplying the number of pieces by two or more. However, it was demonstrated in practice that merely multiplying the number of different pieces of the puzzle does not solve the problem in a desirous manner as the solution of forming different figures may become too difficult as the number of possible combinations of mutual arrangement of the pieces is excessive. Thus, it has been recognized that while a relatively low number of pieces in a set is desirable, a successful puzzle game should, by the same token, have an optimum degree of difficulty in solving different problems. In other words, a successful puzzle should be neither too easy nor too difficult to solve and should have relatively few pieces.

In order to achieve the above objective, it has been proposed to provide puzzles having a relatively small number of pieces of a relatively great variety of different shapes, from simple triangles to multi-lateral shapes. The plurality of complex shapes, however, required relatively high skill in placing the pieces in a storage box (usually a square or rectangular container), with the result that this kind of puzzle was not particularly successful with children as one or more pieces of the puzzle could become lost. In many instances, this type of puzzles proved too difficult to solve mainly due to the complexity of the shape of respective elements.

Reference may be had to U.S. Pat. No. 1,261,710 (Coyle); U.S. Pat. No. 1,430,557 (Jervis); U.S. Pat. No. 2,738,594 (Swingle); U.S. Pat. No. 2,885,207 (Wormser); U.S. Pat. No. 2,886,324 (Cowan); U.S. Pat. No. 3,637,217 (Kent); Canadian Pat. No. 216,154 (Fryer) and Canadian Pat. No. 264,897 (Findlay), the aforesaid patents being indicative of prior art as referred to hereinbefore.

It is an object of the present invention to provide a set of geometric figure building elements of the above type that would contain a relatively small number of pieces, all of the pieces having a simple shape, yet allowing great variety of figures to be built.

Another object of the present invention is to provide a puzzle game which would be capable of formation of a square by utilizing all pieces of the game, wherein the formation of the square belongs to the most difficult problems of the game. Another object of the invention is to provide a puzzle game which is particularly suitable for making animal or human imitation figures. Furthermore, the object of the invention is to produce a puzzle game that would be relatively inexpensive to produce and to maintain in storage (in particular in a square shaped box) while maintaining an easy control over the completeness of the set when not in use.

In general terms, the present invention provides, in one aspect thereof, a set of straight-sided, generally flat, geometric figure building elements, said set being formed by a plurality of elements capable to form square figures of generally identical size, said elements being each of the type and number such that each of said square figures can be formed solely by one type of the respective element, the set comprising a plurality of first elements, second elements and third elements, each of said first elements having the shape of a right-angled, isosceles triangle whose two sides are each generally equal in length to the length of the side of a respective square figure; each of said second elements having the shape of a right-angled, isosceles triangle whose base is generally equal in length to the side of a respective square figure; each of said third elements having the shape generally identical with the shape of the respective square figure.

In another embodiment, the present invention provides a set of generally flat figure building pieces consisting of: a plurality of square shaped pieces of generally identical size, the sides of each piece having a predetermined length; a plurality of first triangular pieces of generally identical size, each of the first triangular pieces having the shape of a right-angled isosceles triangle whose sides are each generally equal in length to said predetermined length; a plurality of second triangular pieces of generally identical size, each of the second triangular pieces having the shape of a right-angled isosceles triangle whose base is of a length generally equal to said predetermined length.

In a further embodiment of the present invention, a set of flat puzzle pieces is provided which consists of: five square shaped pieces of generally identical size, the sides of each piece having a predetermined length; four first triangular pieces of generally identical size, each of the first triangular pieces having the shape of a right-angled isosceles triangle whose sides are generally equal in length to said predetermined length; four second triangular pieces of generally identical size, each of the second triangular pieces having the shape of a right-angled isosceles triangle whose base is of a length generally equal to said predetermined length.

Preferably, said elements or pieces have each a generally parallel top and bottom surface, both surfaces being of generally identical finish, at least some of the elements or pieces being provided on one surface only with a dot-like figure located generally centrally of the respective surface. It is even more preferred that said dot-like figures be provided in one surface only of each of the elements or pieces and be disposed generally centrally of the respective surface.

The invention will now be described by way of one embodiment, namely that of a geometric puzzle game, with reference to the accompanying drawings in which:

FIG. 5 is a cross-sectional view V—V of FIG. 3;

FIG. 6 is a cross-sectional view along the line VI—VI of FIG. 4; FIGS. *7a*, *7b* and *7c* are schematic representations of the solution of three different figures.

Figure 1:
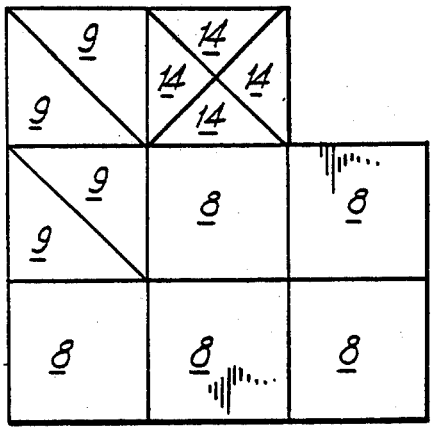
FIG. 1 is a schematic, simplified drawing showing the shape of the set of a preferred embodiment of the present invention, when used in a puzzle game.
Figure 2:
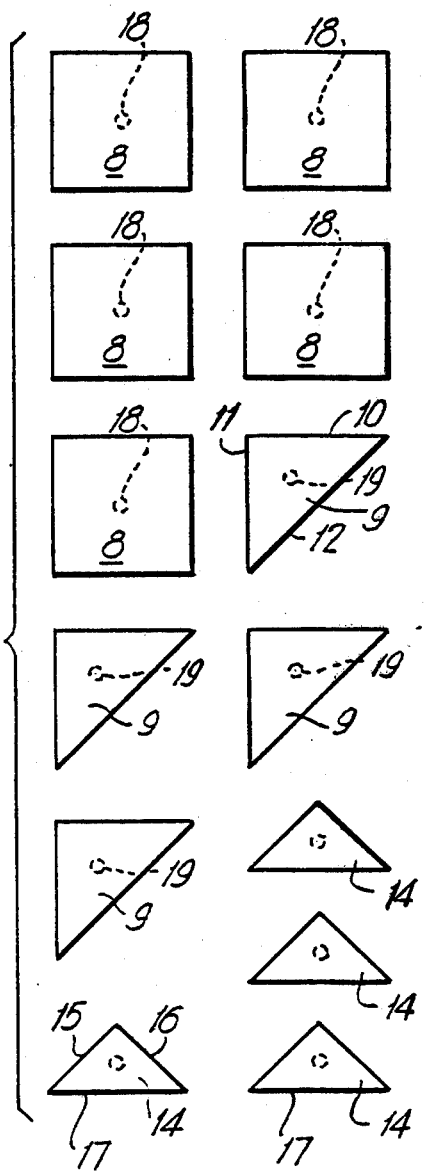
FIG. 2 is an exploded view of the set showing the individual elements of same in a greater detail.
Figure 3:
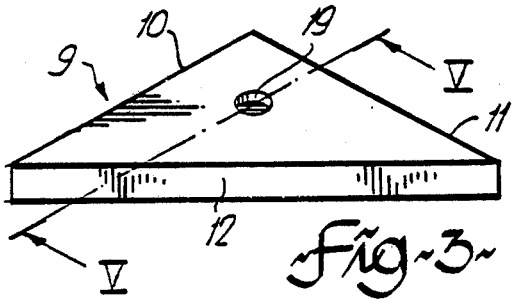
FIG. 3 is a perspective view, not to scale, of one of the pieces shown in FIG. 2.
Figure 4:
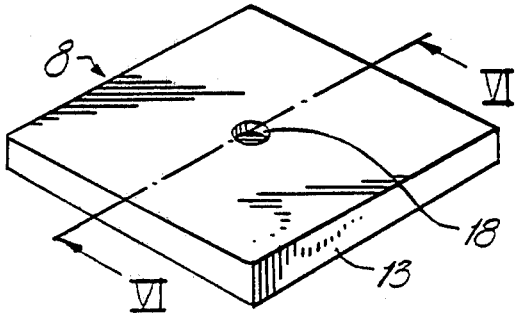
FIG. 4 is a perspective view, not to scale, of another one of the pieces shown in the set of FIG. 2.

Turning in particular to FIGS. 1 and 2, each of these figures shows a set of five square-shaped pieces or elements 8. Since all of such pieces or elements are of a generally identical shape, they are each referred to with the same reference numeral.

The set further comprises four pieces or elements which are also referred to as "first" triangular elements or pieces 9. It will be appreciated on review of FIG. 1 that each triangular piece 9 has two sides 10, 11 and one base 12. Each of the square shaped pieces 8 has four equal sides 13.

The set further comprises a set of four triangular elements, also referred to as "second" triangular elements or pieces 14. Each second element or piece 14 is also of the shape of an isosceles right-angled triangle having two sides 15, 16 and a base 17. FIG. 1 shows clearly that the length of base 17 of each of the second triangular pieces 14 is equal to the length of one side 13 of any of the square shaped pieces 8.

In the shown preferred embodiment, the pieces are made of a suitable plastic material such as acrylic or the like, both surfaces of each of the pieces being of generally the same finish or colour. However, each of the pieces is provided, in one surface only, with a dot-shaped figure in the form of a circular depression. Thus, each of the pieces 8 has a circular depression 18, while each of the first triangular pieces has a similar depression 19. The small triangular pieces 14 also have each a depression as shown. The depressions are all of generally the same size regardless of the actual size of the respective piece. They are finished in a colour distinct from a colour of the rest of the respective piece. For instance, if the piece is of dark red colour, the dot may be white or the like. The dot-shaped FIGS. 18 and 19 are arranged such that if the opposite surface of the respective piece is up, the dot-shaped figure does not show. Thus, when assembling a figure, for instance the figure of a bird as in FIG. *7a*, one of the first triangular pieces 9 may be turned such that its dot-like FIG. 19 shows, while the remaining pieces or elements are placed such that their respective dot-like figures are not visible.

It will be appreciated that the present set may also be referred to as containing a plurality of "square figures" the term "square figure" in this context meaning any of the elements 8, or an assembly of two triangular pieces 9 (for instance the upper left assembly of FIG. 1), or, finally, an assembly of four triangular pieces 14 (the upper square in FIG. 1). Thus, each of the respective square figures is relatively easy to assemble. Since there are only 8 such "square figures", the entire assembly can be easily placed in a box such that four "square figures" are placed on top of another set of four "square figures", thus making the placement of the complete set of pieces in a square-shaped container, whose side is twice the length of the side 13, very easy even for small children. The aforesaid feature is of particular significance when applying the present invention in a different field, e.g. in a floor tile or paving slab field, as in such fields it facilitates packaging of the product.

One of the interesting features of the present invention is that the set not only facilitates an easy stacking in a square-shaped container and enables the formation of different figures which may be described in a suitable brochure or the like without indication of how the individual figures are arranged; it also makes it possible to produce a square figure in which all of the pieces of the preferred embodiment must be used. Such square arrangement is not shown in the drawings; it can be made by first making a cross-shaped figure from the square pieces, then filling the respective corners between the arms with triangles 9 and, finally, placing pieces 14 on ends of the arms with the respective bases 17 coincident with the respective sides 13 of the squares. On the other hand, if the invention is used in a puzzle for less demanding shapes, for instance, as a puzzle set for primary school children, it is possible to utilize the presence of dot-like figures in the set to indicate some of the peripheral pieces within a given shape to be solved by a dot thus unequivocally indicating that a particular portion of the overall shape is formed by a particular type of piece. For instance, the dots at the bottom pieces 9 of FIG. *7c*, if shown in an instruction booklet (with the rest of the figure, of course, being shown only by the contour line), will show the player that the two pieces are triangles 9. If the dots are not shown, the solution is more demanding as the player does not know whether the downwardly convergent portions are to be built by a triangle 9 or by a portion of a square 8.

Those skilled in the art will readily appreciate that further modifications of the present invention may exist. The dot-like figure does not have to be a depression; it can be simply a painted figure. It can also be omitted.

It is also emphasized that the present invention is not necessary limited to the art of geometrical puzzles, even though that particular art is believed to be most likely to exploit all potentials of the invention. The invention can be used, for instance, in the art of modular furniture sets, in the art of playing field elements, as an ornamental tile set and in my other practical applications. Therefore, the term of "figure building element" or "figure building pieces" used hereinbefore and hereinafter, is not limited to puzzle pieces but includes many further areas of application of the gist of the present invention.

One of many practical applications that readily come to mind as an alternative to the preferred embodiment is a set of pavement blocks or tiles of at least two different surface finish for use in a sidewalk, a floor or the like, wherein one set of the blocks would be used to build different figures, while the other set would be used to square the vicinity of the figure, the unique combination of the size and shape of the three basic pieces being the only shape necessary for a very broad spectrum of different figures in a pavement or the like.

Thus, it follows from the above that many embodiments differing from the described preferred embodiment of the present invention may exist which, while departing from the preferred embodiment, do not depart from the scope of the present invention as set forth in the accompanying claims.

I claim:

1. A set of generally flat puzzle pieces consisting solely of:

(a) five square shaped pieces of generally identical size, the sides of each piece having a predetermined length;

(b) four first triangular pieces of generally identical size, each of the first triangular pieces having the shape of a right-angled isoscles triangle whose sides are each generally equal in length to said predetermined length;

(c) four second triangular pieces of generally identical size, each of the second triangular pieces having the shape of a right-angled isoscles triangle whose base is of a length generally equal to said predetermined length.

2. A set as claimed in claim 1, wherein said pieces have such a generally parallel top and bottom surface, both surfaces being of a generally identical finish, one surface only of each of said pieces being provided with a dot-like figure disposed generally centrally of the contour of the respective piece.

* * * * *